United States Patent [19]

Delap et al.

[11] Patent Number: 4,862,623

[45] Date of Patent: Sep. 5, 1989

[54] QUICK LOADING DEVICE FOR MUZZLE-LOADED WEAPONS

[76] Inventors: Jess E. Delap; James D. Delap, both of P.O. Box 116, West Point, Calif. 95255

[21] Appl. No.: 241,053

[22] Filed: Sep. 6, 1988

[51] Int. Cl.[4] ..... F41C 27/00

[52] U.S. Cl. ..... 42/90

[58] Field of Search ..... 42/90

[56] References Cited

U.S. PATENT DOCUMENTS

| | | | |
|---|---|---|---|
| 243,250 | 6/1881 | Hall | 42/90 |
| 4,050,175 | 9/1977 | Mulinix | 42/90 |
| 4,112,606 | 9/1978 | Griffin | 42/90 |
| 4,123,868 | 11/1978 | Wilson | 42/90 |
| 4,135,322 | 1/1979 | Tice et al. | 42/90 |
| 4,152,858 | 5/1979 | Dobbs | 42/90 |
| 4,207,698 | 6/1980 | Burson | 42/90 |
| 4,229,897 | 10/1980 | Snowden | 42/90 |
| 4,373,285 | 2/1983 | Grout et al. | 42/90 |
| 4,411,088 | 10/1983 | Wilson | 42/90 |
| 4,442,620 | 4/1984 | Drake et al. | 42/90 |
| 4,536,983 | 8/1985 | Fry | 42/90 |
| 4,550,517 | 11/1985 | Mansfield | 42/90 |
| 4,601,125 | 7/1986 | Curtis | 42/90 |

*Primary Examiner*—Charles T. Jordan

*Attorney, Agent, or Firm*—James M. Ritchey

[57] ABSTRACT

A quick loader for muzzle-loaded weapons is disclosed whereby a generally cylindrical body is bored to the desired caliber through the longitudinal axis and fitted with a removable sealing cap, containing a holder for a primer or percussion cap, at the upper end and a fitting for mating to the barrel of a weapon at the lower end. Immediately above the lower end of the body is a rotational valve mounted with the axis of rotation perpendicular to the longitudinal bore. The internal opening in the valve is the same caliber and concentric with the longitudinal bore in the body. When the valve is closed a moisture resistant central cylindrical chamber is created above the valve and below the sealing cap. A premeasured quantity of powder is placed within this chamber and a patched projectile is positioned above the powder and beneath the sealing cap. The device is fitted to the barrel of a muzzle-loaded weapon and the valve rotated to drop the powder into the barrel. Removal of the sealing cap then allows the user to insert a ramrod directly through the device to seat the patched projectile within the barrel of the weapon. The device and ramrod are removed from the weapon to complete the rapid loading.

7 Claims, 1 Drawing Sheet

QUICK LOADING DEVICE FOR MUZZLE-LOADED WEAPONS

BACKGROUND OF THE INVENTION

1. Field of the Invention

A device for quickly loading a muzzle-loaded weapon is disclosed which allows the user to smoothly deliver by means of a ramrod a premeasured amount of powder, a patch, and projectile into the weapon. More particularly, the present invention relates to a quick loading device having a novel construction including a generally cylindrical body having a central bore aligned along the longitudinal axis to include the opening passage through an integral rotatable valve having a rotation axis perpendicular to the central bore axis. The central bore above the valve is a chamber that holds a projectile, patch, and powder. An upper end of the body is fitted with a sealing cap and below the valve is a lower end of the body milled to mate over the barrel of a muzzle-loaded weapon. Upon mating the present invention with the barrel of the weapon, the valve is rotated allowing the powder to enter the barrel. Removal of the sealing cap, which is still attached to the body to prevent loss, allows the user to drive the projectile and patch into the barrel with one motion of a ramrod.

2. Description of the Background Art

Traditionally, several steps have been required to load a muzzle-loaded weapon. A user needs to pour a predetermined quantity of powder into the barrel of the weapon and then force a projectile and patch or wad material on top of the powder by means of a ramrod. Depending on the exact type of weapon, an additional step is required to set the primer or percussion cap on the breech nipple. This procedure requires time and prevents the user from being able to rapidly reload. Stalking the target animal to obtain a close firing range is critical, due to the inherent inaccuracy in aiming these weapons at a distance. A rapid reload is manditory if the user is to get a second shot at the animal target. Such a shot might be required to initially hit the animal, if the first attempt missed, or to bring down an animal wounded by the first shot.

Various attempts have been made over the past decades to produce a device that will allow the user to rapidly reload a muzzle-loaded weapon. In one rudimentary form described in U.S. Pat. No. 243,250, a short tube merely contains a premeasured amount of powder, a wad, and a ball. The only advantage that this apparatus has over the traditional method of loading is that a powder is premeasured and packaged with one wad and ball. Several motions are required to load the weapon.

U.S. Pat. No. 4,123,868 discloses an invention very similar to U.S. Pat. No. 243,250 above. The device is a holder for a premeasured quantity of powder and a projectile. The projectile serves as a plug to seal one end of the tube, but the user still needs several motions to open the holder, pour the powder into the weapon, insert the projectile partially into the barrel, and use a ramrod to dislodge the projectile from the holer and into the barrel. No provision is made for carrying a patch, but the top of the holder serves as a holder for a percussion cap.

U.S. Pat. No. 4,152,858 offers a container-tool that holds the necessary powder, patch, and ball, but involves several steps that slow the reloading procedure.

At one end of the container-tool is a plunger that is fitted over an inner cylinder that contains the powder, patch, and ball. At the other end is a membrane disk that holds the contents in place. The device is fitted over the barrel of the weapon and the plunger pushed to rupture the disk. The powder enters the barrel and the patch and ball are partially insert into the barrel by this plunger action. The device is then removed and the ramrod applied to pack the ball into its final position.

A device is described in U.S. Pat. No. 4,207,698 that consists of two tubes: one to hold a patched ball with a primer and the other to hold the powder. First, the weapon is filled with powder from one tube. Second, the ball containing tube is opened by removing the primer holding lid and the tube is inserted into the barrel. The patched ball delivered into position by a ramrod.

The muzzle-loader explained in U.S. Pat. No. 4,373,285 is similar to the invention given in U.S. Pat. No. 4,152,858 above, except that there is a modified plunger required to rupture the membrane disk. The plunger itself contains the powder and projectile so that once it is used to rupture the disk holding back the powder, a ramrod may be inserted directly through the device to deliver the projectile. Both U.S. Pat. Nos. 4,152,858 and 4,373,285 require several pieces to be assembled each time the device is prepared and a new membrane disk is required for each usage.

U.S. Pat. No. 4,536,983 presents a loading invention very similar to U.S. Pat. No. 4,152,858 above, except this design requires one fewer pieces. The intermediate sleeve used to retain the disk in '858 is not required in '983, otherwise the devices are essentially the same.

A more complex apparatus is illustrated in U.S. Pat. No. 4,550,517. The device has a plurality of chambers, each containing powder, patch, and ball. After mating the device with the barrel of the weapon, the desired chamber is rotationally positioned over the barrel to allow the powder to enter. The lid on the selected cylinder is removed and a ramrod inserted through the device to seat the patched ball. Around the outer perimeter of the lower portion of the device are holder detents for percussion caps.

U.S. Pat. No. 4,601,125 details an invention that fits over the muzzle of a weapon and delivers the premeasured powder by means of a sliding drawer that accesses an outer cylindrical chamber. Once the powder is delivered, the patched ball is partially inserted into the barrel by means of a plunger fixed within the device. The device is removed from the weapon and a ramrod employed to seat the projectile.

SUMMARY OF THE INVENTION

An object of the present invention is to produce an improved loader for muzzle-loaded weapons.

Another object of the present invention is to provide a loader that requires few steps to operate and is thereby reliable and quick to use during field conditions.

An additional object of the present invention is to furnish a non-bulky loader that has few parts and is inexpensive to produce, yet precise in its alignment with the barrel of the muzzle-loaded weapon.

A further object of the present invention is to produce a loader that minimizes the dangers of flash related accidents.

Yet another object of the present invention is to provide a loader that is resistant to moisture.

Still an additional object of the present invention is to furnish a loader that employs a unique valve mechanism to access the premeasured powder, patch, and projectile.

The subject invention, a quick loader for muzzle-loaded weapons, comprises a generally cylindrical body. The body is cylindrially bored the length of the long axis. Engaging the upper end of the body is a sealing cap that is removable, but during use still held to the body by a retentive means such as a strap or cord. This sealing cap is fitted with a holder for a primer or percussion cap. The lower end of the body is bored with an octagon socket or depression concentric with the cylindrical bore and adapted to mate with the barrel of a muzzle-loaded weapon. Above the lower end of the body is a valve mounted as an integral part of the body and having a rotational axis perpendicular to the long axis of the body. When this valve is rotated to the closed position, an internal central cylindrical chamber is formed above the valve and below the sealing cap. Immediately above the closed valve is the load of premeasured powder, patch, and projectile. After the lower end of the body is mated with the barrel of the muzzle-loaded weapon, the valve is rotated to the open position and the powder flows by gravity feed into the barrel. The sealing cap may be removed either before or after the valve is rotated open. After the sealing cap is removed and the valve opened, a ramrod is employed to deliver the patched projectile into its final position within the barrel. The ramrod and quick loader are removed and the weapon is readied to fire by applying the primer.

Other objects, advantages, and novel features of the present invention will become apparent from the detailed description that follows, when considered in conjunction with the associated drawings.

DESCRIPTION OF THE PREFERRED EMBODIMENT

Figure 1:
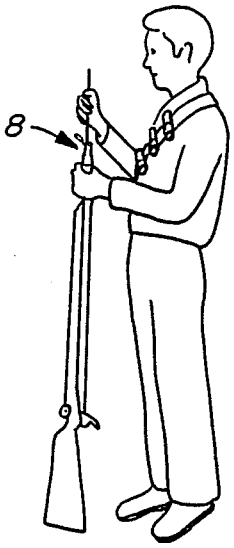
FIG. 1 is a pictorial view of the device in use and a user wearing a Velcro® belt with attached devices.

Referring now to FIGS. 1–5, there is shown a preferred embodiment of a quick loading device 8 of the subject invention. This device is for rapidly loading a muzzle-loaded weapon and may be carried by the user in any convenient location and by any appropriate means such as a lanyard, Velcro® mating strips, as illustrated in FIG. 1, snaps, or similar means.

Figure 2:
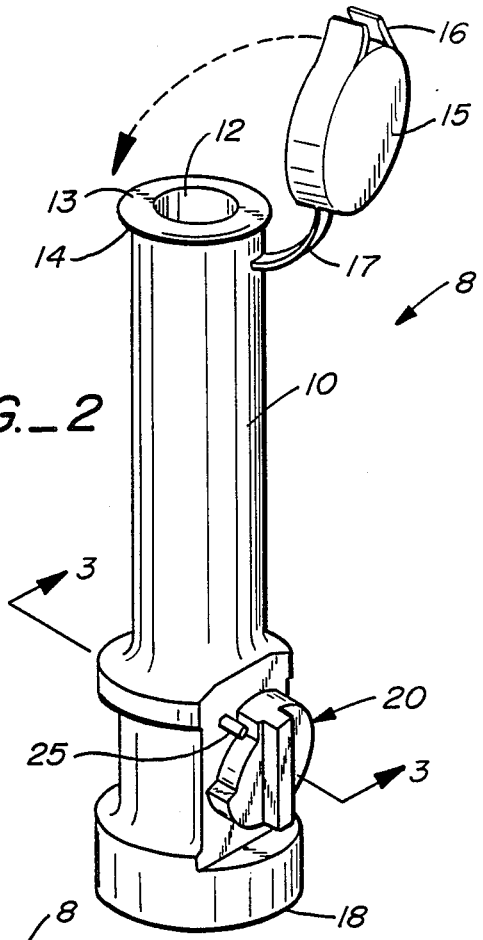
FIG. 2 is a perspective of the device (emptied).

The subject invention, as illustrated in particular in FIG. 2, comprises a body 10 of generally cylindrical shape although other proportions are contemplated as being adequate. Materials such as plastics, rubbers, or metals may be employed to produce the body 10, preferably a resilient, machineable, and spark resistent plastic. Methods of fabricating the body 10 such as injection molding, turning on a lath, or like processes are contemplated in this disclosure.

Figure 3:
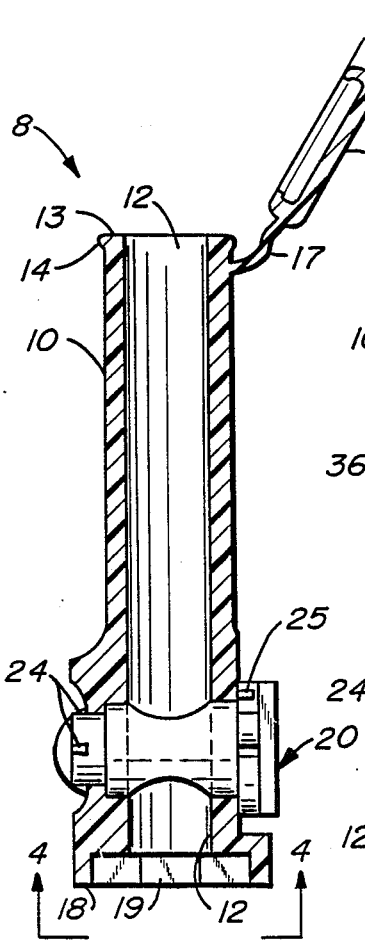
FIG. 3 is a cross sectional side elevation of Fig. 2 at 3—3 (emptied).

As seen in FIG. 3, there is a central cylindrical bore 12 extending the length of the long axis of the body 10. The diameter of the central cylindrical bore 12 is selected to match the diameter or caliber of the muzzle of the weapon the user desires to load. Any appropriate method of introducing this bore is contemplated, including, but not limited to, injection molding, line boring, and the like.

At the top or upper end 13 of the body 10 is a sealing rim 14 that mates with a sealing cap 15 to produce a moisture and filth resistant seal. To engage the sealing cap 15 to the sealing rim 14, any conventional mating means are appropriate such as a pressure fitting, a threaded unit, a bayonet mounting, or similar fixture. So that the sealing cap 15 is not lost during loading, a cap retentive means 17 is attached between the body 10 and the sealing cap 15. If the body 10 portion of the subject device is injection molded, the cap retentive means 17 and the sealing cap 15 would be formed at this time. However, any conventional attach means are contemplated as suitable for the cap retentive means 17 including a cord or wire, Velcro® mating strips, magnetic devices, or like mechanisms.

Some muzzle-loaded weapons require a primer or percussion cap to initiate the weapon's discharge. To accomodate this possibility, the sealing cap 15 is adapted with a primer holder 16. Primers or percussion caps are relatively small items and easily misplaced, especially under field conditions during a hunt. A pressure fitting is incorporated into the sealing cap 15 to hold one primer per load. Usually, the user would simply hold the subject invention, with the sealing cap 15 mated to the sealing rim 14, and apply the primer to the nipple of the weapon, but the non-mated sealing cap 15 could be held in a similar manner.

Figure 4:
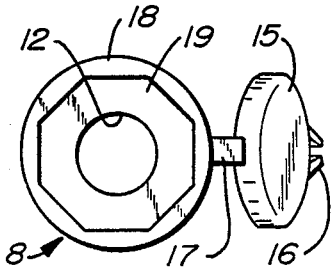
FIG. 4 is a bottom view of the device (emptied).

At the bottom or lower end 18 of the body 10, as illustrated in FIG. 4, is a fitting or socket 19 adapted to mate with the barrel of a muzzle-loaded weapon. The socket 19 is bored or molded into the lower end 18 of the body 10 to be concentric with the central cylindrical bore 12. Since most muzzle-loaded weapons have an octagon barrel, the socket 19 is preferably of octagonal configuration, but other shapes are contemplated by this disclosure.

Figure 3A:
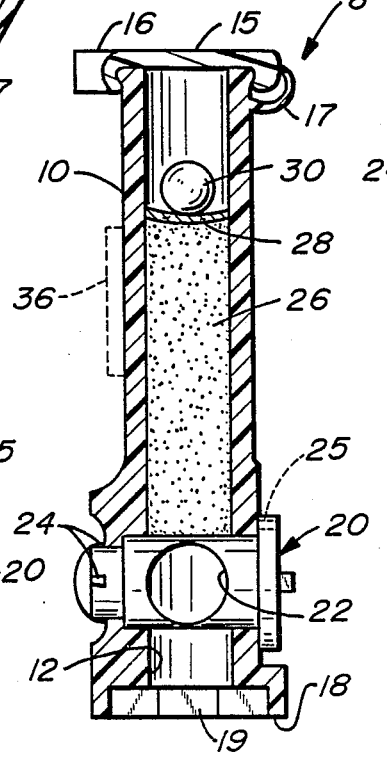
FIG. 3A is a cross sectional side elevation of FIG. 2 at 3—3 (loaded).
Figure 5:
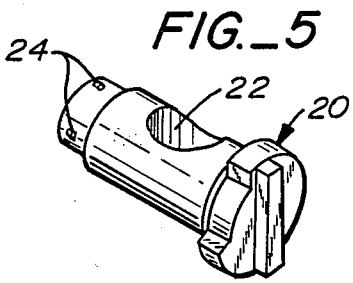
FIG. 5 is a perspective view of the valve piece.

A critical part of the subject invention is a rotatable valve 20 positioned above the lower end 18 of the body 10, see FIGS. 2, 3, 3A, and 5. Valve 20 has a rotational axis perpendicular to the long axis of the body 10. As seen in FIGS. 3 and 3A, the internal cylindrical portion of valve 20 is bored with a cylindrical opening 22 of equivalent diameter or caliber to that of the central cylindrical bore 12. This opening 22 in the valve 20 may be line bored at the same time the central cylindrical bore 12 is bored or formed by any other conventional means. Being perpendicular to the longitudinal axis of the central cylindrical bore 12, when the valve 20 is rotated to the closed position, as seen is FIG. 3A, an internal cylindrical chamber is formed in the central cylindrical bore 12 above the valve 20 and below the sealing cap 15. It is within this chamber that the load is secured. The valve is held within the body 10 of the subject invention by retentive means 24. These valve retentive means 24 may be of conventional types including compressable detents molded directly into the valve 20, shown in FIG. 5, a standard O-ring, a metal or plastic snap ring, or like devices. The joint between the valve 20 and the body 10 may be machined, molded, or produced by like procedures to create a moisture and filth resistant seal, thereby protecting the powder 26 from being dampened or contaminated by field conditions during use. A stop pin 25 is included in the subject invention. The stop pin 25 is placed to allow the operator to quickly shift from the closed position to the open position during loading.

Upon closing the rotatable valve and producing the internal chamber in the central cylindrical bore, the user may fill the loader with powder 26, a patch (or wad) 28, and a projectile 30. A premeasured quantity of powder 26 is poured into the chamber. Above the powder 26 is placed a patch 28 and any appropriate projectile 30 such as a ball, shown in FIG. 3A, bullet, or similar object or objects. Although FIG. 3A shows a ball 30 and a patch 28 within the chamber, it is contemplated by this disclosure that certain projectiles do not require a patch 28.

To employ the quick loading device 8 the user merely fits the subject invention over the barrel of a caliber matched weapon and turns the rotatable valve 20 to the open position, thereby allowing the powder 26 to pour into the barrel of the weapon. The sealing cap 15 is either removed before the rotatable valve 20 is opened or after, but in either case after the valve 20 is opened the user applies a ramrod, shown in FIG. 1, directly through the subject invention to drive the patch 28 and projectile 30 home within the barrel. Both the ramrod and the quick loading device 8 may then be removed from the barrel. If a primer or percussion cap is required for firing the weapon, the holder 16 on the sealing cap may be used to seat this item on the weapon.

As is illustrated in FIG. 3A, the quick loading device 8 may be fitted with an attachment means 36 that allows the user to carry a plurality of loaded quick loaders 8. Any suitable attachment means 36 are contemplated, including Velcro® mating strips, snaps, lanyard, and like devices. Loaders 8 may be attached to or carried in the user's belt, jacket, pack, carying case, or similar device.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. A device for quickly loading a muzzle-loaded weapon, comprising:

(a) a generally cylindrical body with a central cylindrical bore extending the length of the long axis of said body;

(b) an upper end of said body fitted with a sealing cap and a lower end of said body adapted to mate for loading with the barrel of said muzzle-loaded weapon and;

(c) a rotatable valve mounted within said body and having a rotational axis perpendicular to said long axis of said body, wherein said valve is adapted to produce, when closed, a central cylindrical chamber above said valve that can contain a projectile, patch, and powder to be loaded into a mated muzzle-loaded weapon by opening said valve and sealing cap and inserting a ramrod through said upper end of said body and said valve with a single action and into said weapon.

2. A device for quickly loading a muzzle-loaded weapon according to claim 1, wherein said sealing cap includes a holder for a primer.

3. A device for quickly loading a muzzle-loaded weapon according to claim 1, wherein said lower end of said body is bored with an octagonal socket so as to mate securely with an octagonal barrel of a muzzle-loaded weapon.

4. A device for quickly loading a muzzle-loaded weapon according to claim 1, wherein said valve is located immediately above said lower end.

5. A device for quickly loading a muzzle-loaded weapon according to claim 1, wherein said valve comprises a central bore matched in diameter to said central cylindrical bore of said body.

6. A device for quickly loading a muzzle-loaded weapon, comprising:

(a) a generally cylindrical body with a central cylindrical bore extending the length of the long axis of said body;

(b) an upper end of said body fitted with a sealing cap adapted to hold a primer;

(c) a lower end of said body bored with an octagonal socket concentric with said long axis of said body and adapted to mate with an octagonal barrel of said muzzle-loaded weapon;

(d) a rotatable valve mounted within said body and immediately above said lower end of said body and having a rotational axis perpendicular to said long axis of said body, wherein said valve is bored with a cylindrical opening of the same diameter as said central cylindrical bore of said body and is adapted to produce, when closed, a central cylindrical chamber above said valve that can contain a projectile, patch, and powder to be loaded into a mated muzzle-loaded weapon by opening said valve and sealing cap and inserting a ramrod through said upper end of said body and said valve with a single action and into said weapon.

7. A device for quickly loading a muzzle-loaded weapon according to claim 6, wherein said sealing cap and said valve resist the entrance of moisture into said central cylindrical chamber.

* * * * *